US006967296B2

(12) United States Patent
Kato

(10) Patent No.: US 6,967,296 B2
(45) Date of Patent: Nov. 22, 2005

(54) STEERING SWITCH DEVICE

(75) Inventor: Tatsuya Kato, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/983,866

(22) Filed: Nov. 8, 2004

(65) Prior Publication Data

US 2005/0098416 A1 May 12, 2005

(30) Foreign Application Priority Data

Nov. 10, 2003 (JP) ..... 2003-380103

(51) Int. Cl.[7] ..... H01H 9/00
(52) U.S. Cl. ..... 200/61.54; 200/61.57
(58) Field of Search ..... 200/5 R, 61.54–61.57, 200/293; 180/78, 338

(56) References Cited

U.S. PATENT DOCUMENTS 5,043,545 A * 8/1991 Yamashita et al. ..... 200/293
5,924,552 A * 7/1999 Yu ..... 200/296
5,949,149 A 9/1999 Shitanaka et al.
6,013,884 A 1/2000 Rudolph et al.
6,151,980 A 11/2000 Nishitani et al.
6,525,283 B2 * 2/2003 Leng ..... 200/339
6,624,365 B2 * 9/2003 Miyako et al. ..... 200/61.54
6,781,071 B2 * 8/2004 Leng et al. ..... 200/61.54
6,837,514 B1 * 1/2005 Fujita et al. ..... 280/731
2003/0155219 A1 8/2003 Leng et al.

* cited by examiner

*Primary Examiner*—Michael A. Friedhofer
(74) *Attorney, Agent, or Firm*—Brinks Hofer Gilson & Lione

(57) ABSTRACT

An upper plate portion having a pair of openings formed therein, an external surface portion inclined to the inner side from an upper end of the outer circumference of the upper plate portion toward the lower side of the case, and a holding plate portion protruding from an inner surface of the external surface portion toward the inner side are integrally provided in a case. A cover is inserted into the case from the sides of the upper plate portion and the holding plate portion to be integrated with the case constitute a switch housing. Operating knobs are fitted to the case from the upper sides of the openings to thus assemble a switch unit. The switch unit is fixed to the side portion of a pad portion of a steering wheel, so that the operating knobs protrude to a space between the inner circumference of a ring portion and the pad portion.

7 Claims, 7 Drawing Sheets

STEERING SWITCH DEVICE

This application claims the benefit of priority to Japanese Patent Application No. 2003-380103 filed on Nov. 11, 2003, herein incorporated by reference.

BACKGROUND OF THE INVENTION

1. Field of the Invention

The present invention relates to a steering switch device attached to a steering wheel of an automobile, capable of enabling an operator to control a variety of electric devices.

2. Description of the Related Art

Conventionally, a steering switch device in which a plurality of operating knobs is arranged at arbitrary locations, for example, spoke portions for connecting an annular ring portion and a central pad portion, and in which a driver selectively operates the operating knobs with hands to activate a push button switch arranged in each of the operating knobs is known (for example, see Japanese Unexamined Patent Application Publication No. 2001-35312 (pages 4 to 6, FIGS. 2 to 6).

In such a steering switch device, each of the operating knobs is fixed on an upper surface of a case made of synthetic resin so as to be slidable and to be movable in the vertical direction, and the push button switch mounted on a circuit substrate is accommodated in the case. A lower portion of the case is opened, and the push button switch and the circuit substrate are inserted into the case from the lower opening end of the case. Further, the lower opening end of the case is covered with a cover, and the cover is bonded to the case to be integrated into one body using a plurality of screws. The case and cover constitute a switch housing, and the switch housing is fixed to a concave portion provided in the spoke portion.

However, in recent years, the types and the number of the operating knobs attached to the steering wheel have been increased along with diverse designs of steering wheels. Because of the trend, a steering wheel device in which the switch housing is fixed to a side portion of the pad portion and the operating knobs arranged on the upper surface of the switch housing are placed in a space surrounded by the ring portion and the pad portion has been required. According to the steering switch device, since the driver can easily operate the operating knobs without removing hands from the ring portion, it is possible to improve the operability of the operating knobs. However, a problem in external appearance is generated. Specifically, when the switch housing is fixed on the side surface of the pad portion, the surface appearance of the switch housing is gradually inclined toward the inner side so that the surface appears to form an inclined surface. Further, in the above-mentioned conventional steering switch device, the case and the cover constituting the switch housing is divided into two parts in the vertical direction, so that a dividing line (bonding line) between the case and the cover is really noticeable in the switch housing, which consequently deteriorates the appearance.

SUMMARY OF THE INVENTION

Accordingly, the present invention has been made to solve the above-mentioned problems, and it is an object of the present invention to provide a steering switch device capable of fixing a switch housing on a side portion of a pad portion without deteriorating the appearance of the switch housing.

In order to achieve the above-mentioned object, the present invention provide a steering switch device comprising a steering wheel in which a pad portion is connected to an inner side of an annular ring portion through spoke portions; a switch housing fixed to side portions of the pad portion; operating knobs arranged on a top surface of each of the switch housing; switching elements operated by the operating knobs; and a circuit substrate on which the switch elements are mounted, the switch housing comprising a case and a cover made of a synthetic resin which are integrally linked to each other, in which an upper plate portion having the operating knobs arranged thereon, an external surface portion inclined inward from an upper end of the outer circumference of the upper plate portion toward the lower side of the case, and a holding plate portion protruding from an inner surface of the external surface portion toward the inner side to face the upper plate portion are integrally provided in the case, and in which the cover is inserted between the upper plate portion and the holding plate portion, a lower plate portion for fixing the circuit substrate is provided in the cover, and the lower plate portion is mounted on the holding plate portion.

In the steering switch device having the above-mentioned structure, by using the holding plate portion protruding from the inner surface of the external surface portion inclined to the inner side from the upper end of the outer circumference of the upper plate portion toward the lower side as an inserting guide, it is possible to simply fit the cover to the case, and it is possible to locate the case and the cover in the height direction to constitute the switch housing. Therefore, regardless of fixing the switch housing to the side portion of the pad portion to thus improve the operability of the operating knobs, it is possible to prevent the dividing line between the case and the cover from occurring in the external appearance of the switch housing.

In the above-mentioned steering switch device, guide protrusions are integrally provided on a back surface of the lower plate portion, and cut-out portions into which the guide protrusions are inserted are formed in the holding plate portion. In this case, when inserting the lower plate portion of the cover into the case along the holding plate portion, the guide protrusions are fitted into the cut-out portions, so that the case and the cover are located in the horizontal direction. Therefore, it is possible to simply fit the cover to the case.

In the above-mentioned steering switch device, it is preferable that the guide protrusion have a leg portion, and that the holding plate portion is sandwiched between the leg portion and the back surface of the lower plate portion when the guide protrusion is inserted into the cut-out portion. According to this structure, the case and the cover can be surely located in the horizontal direction, and the case and the cover can be bonded to each other to be integrated into one body.

In the above-mentioned configuration, it is preferable that a driver be provided between the operating knob and the switch element, that an opening into which the driver is inserted be formed in the upper plate portion of the case, and that a guide portion which guides an ascending/descending movement of the driver be provided in an inner wall of the opening. According to the above-mentioned configuration, the switch element mounted on the circuit substrate can be surely operated, and the driver can be fitted into the case from the upper side of the opening. In this case, a steering switch device corresponding to a single structure in which a single operating knob or driver is provided in the switch housing may be used. Alternatively, it is preferable that in a steering switch device, a plurality of the openings be formed in the upper plate portion of the case so as to be adjacent to each other, and that a plurality of the operating knobs be provided on the upper plate portion so as to correspond to the plurality of openings, respectively.

DESCRIPTION OF THE PREFERRED EMBODIMENTS

Figure 1:
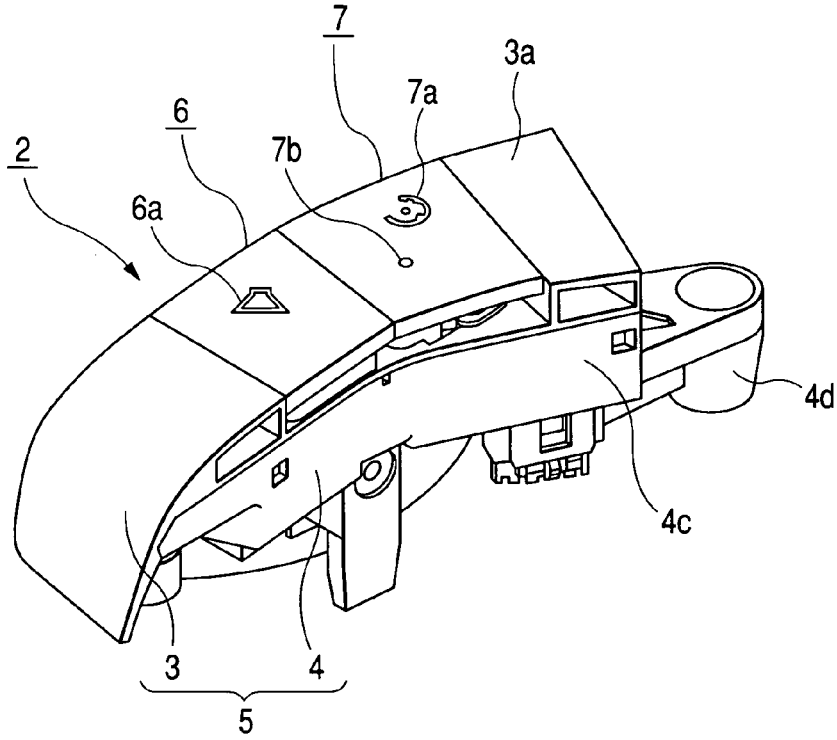
FIG. 1 is a perspective view of a switch unit according to an embodiment of the present invention.
Figure 2:
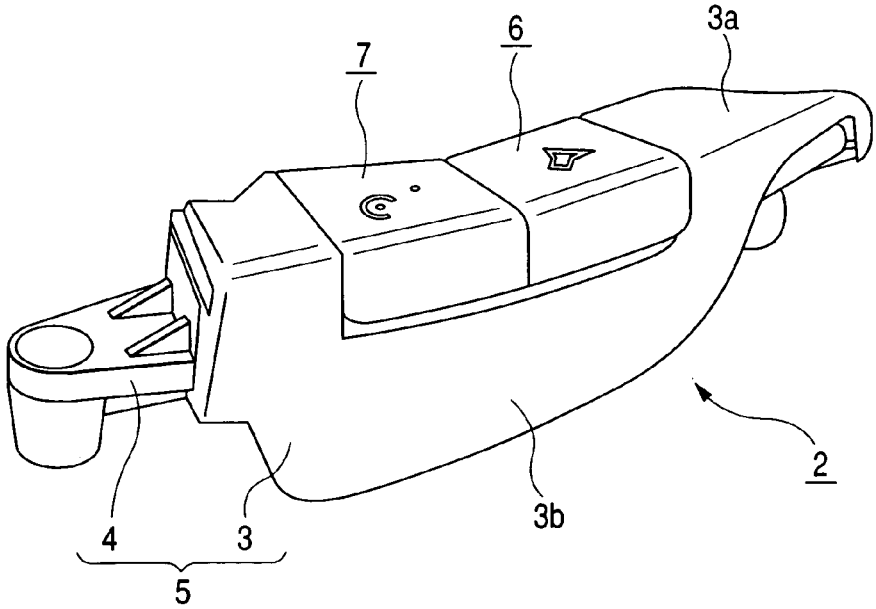
FIG. 2 is a perspective unit of the switch unit as viewed from a different direction.
Figure 3:
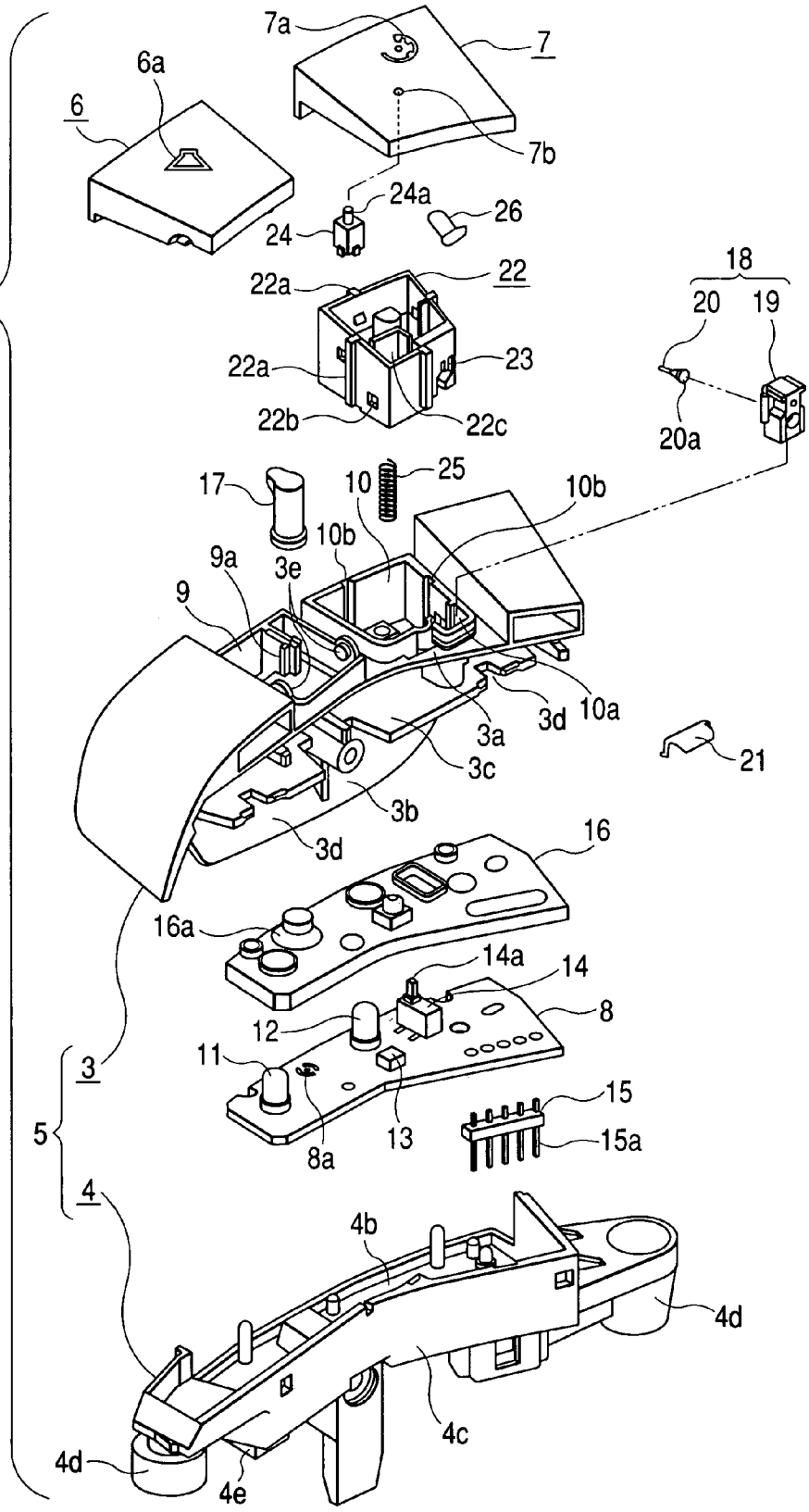
FIG. 3 is an exploded perspective view of the switch unit.
Figure 4:
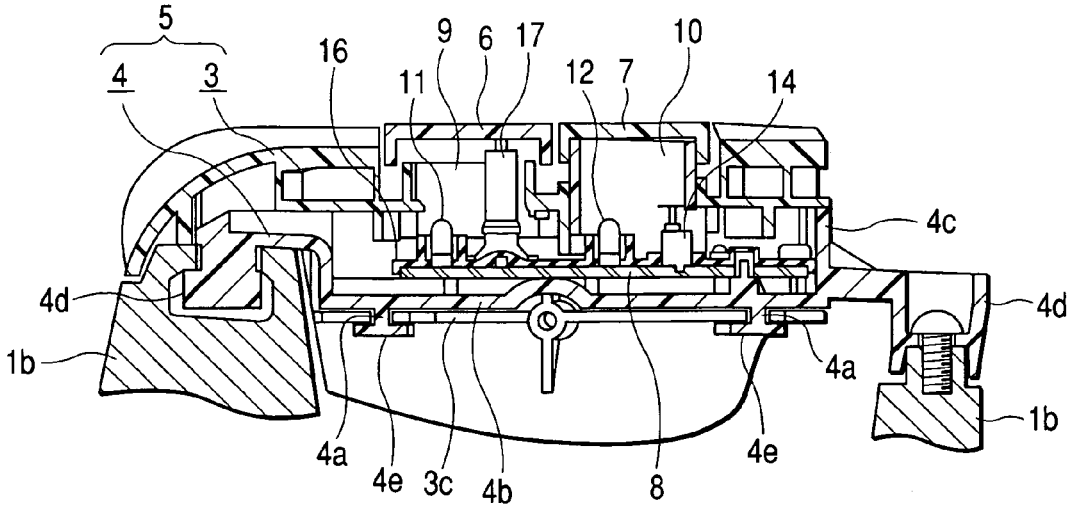
FIG. 4 is a sectional view of the switch unit.
Figure 5:
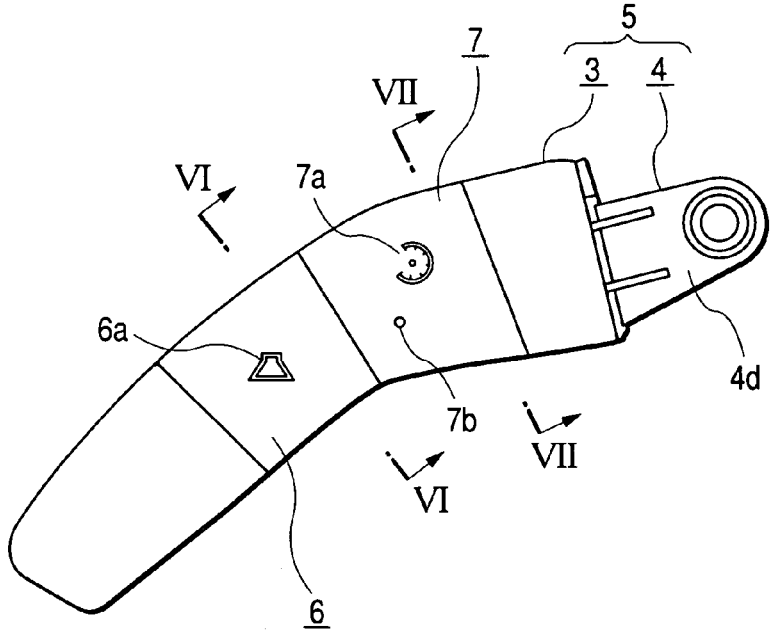
FIG. 5 is a plan view of the switch unit.
Figure 6:
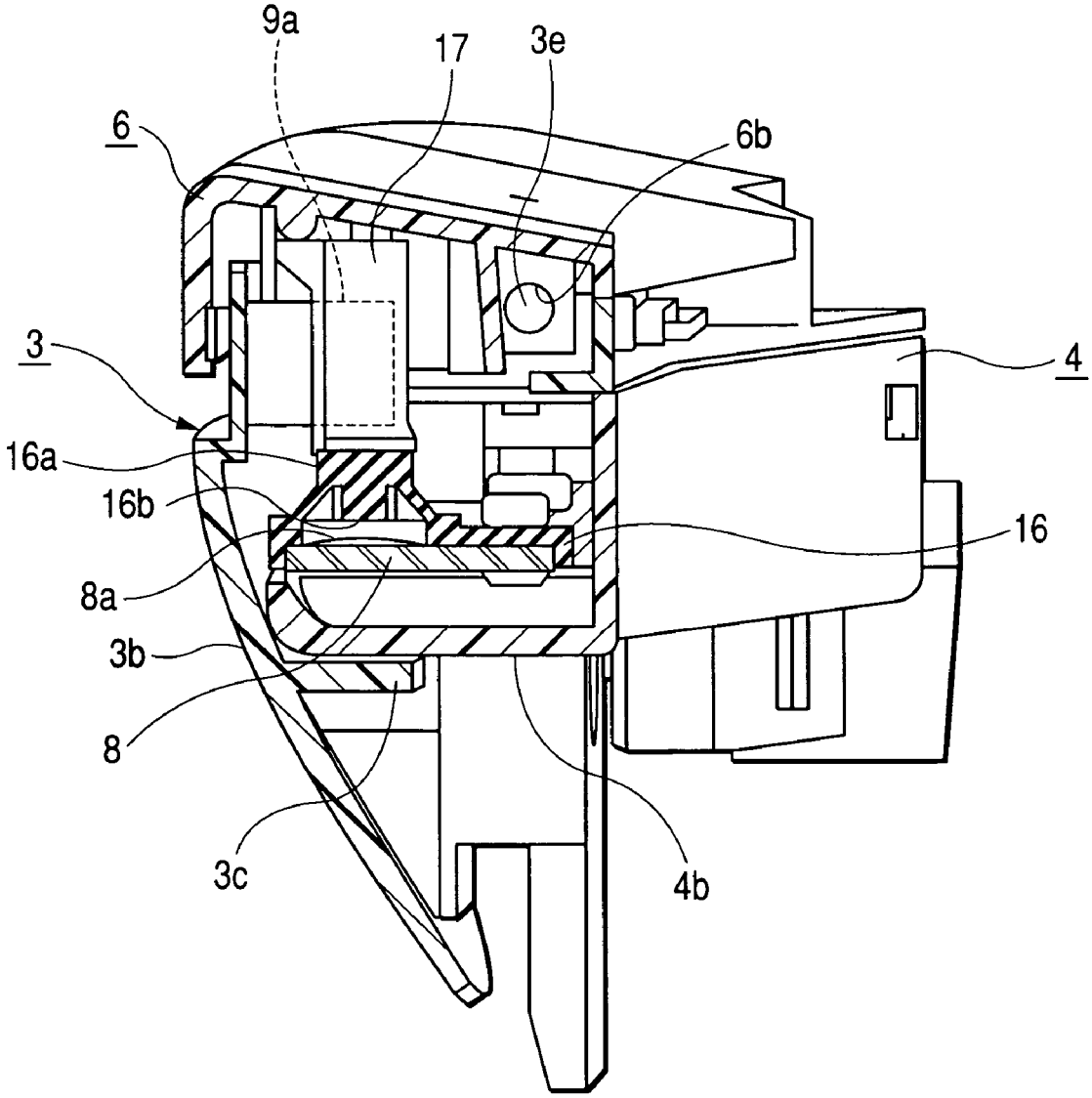
FIG. 6 is an enlarged sectional view of the switch unit taken along the line VI—VI of FIG. 5.
Figure 7:
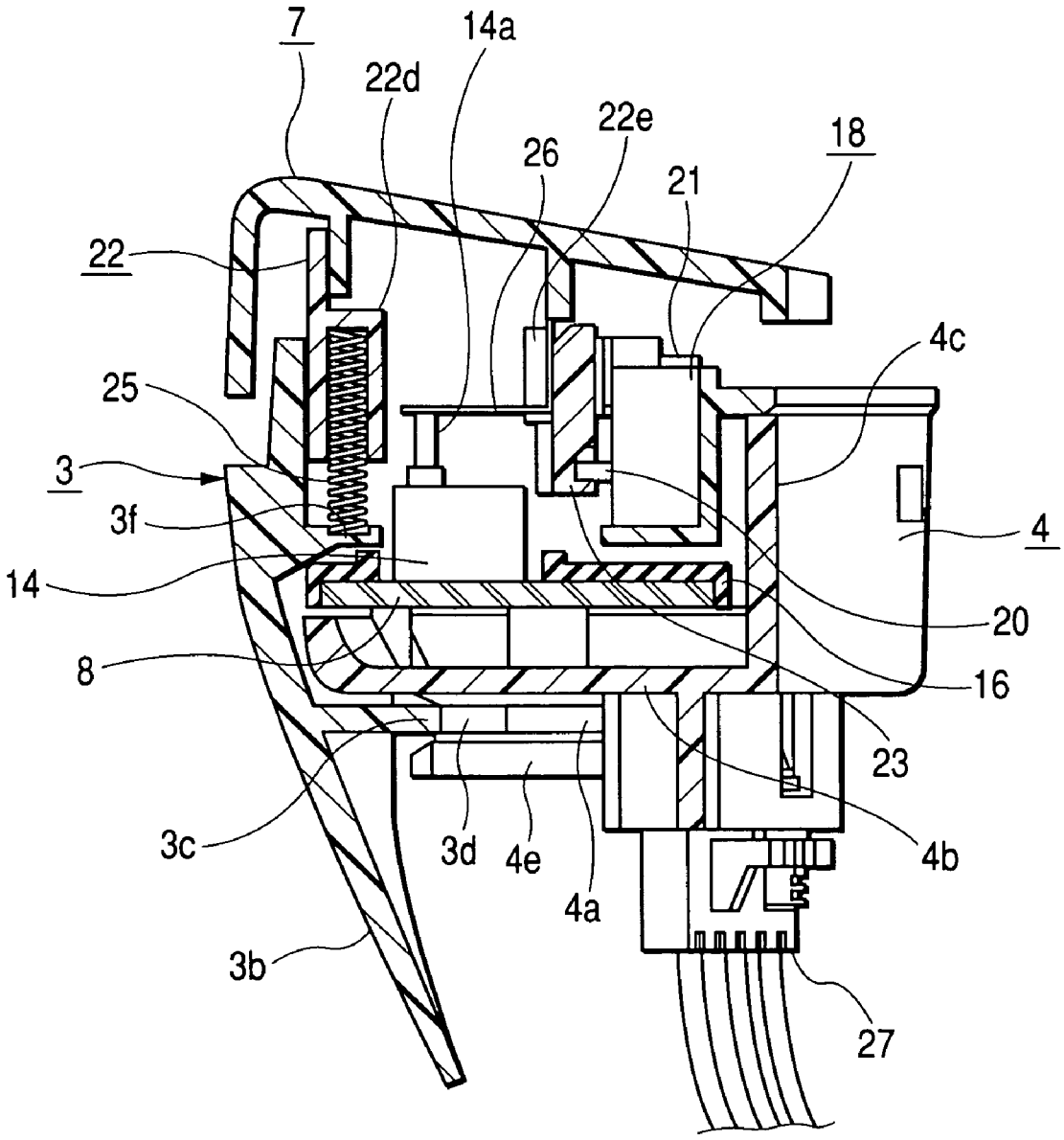
FIG. 7 is an enlarged sectional view of the switch unit taken along the line VII—VII of FIG. 5.
Figure 8:
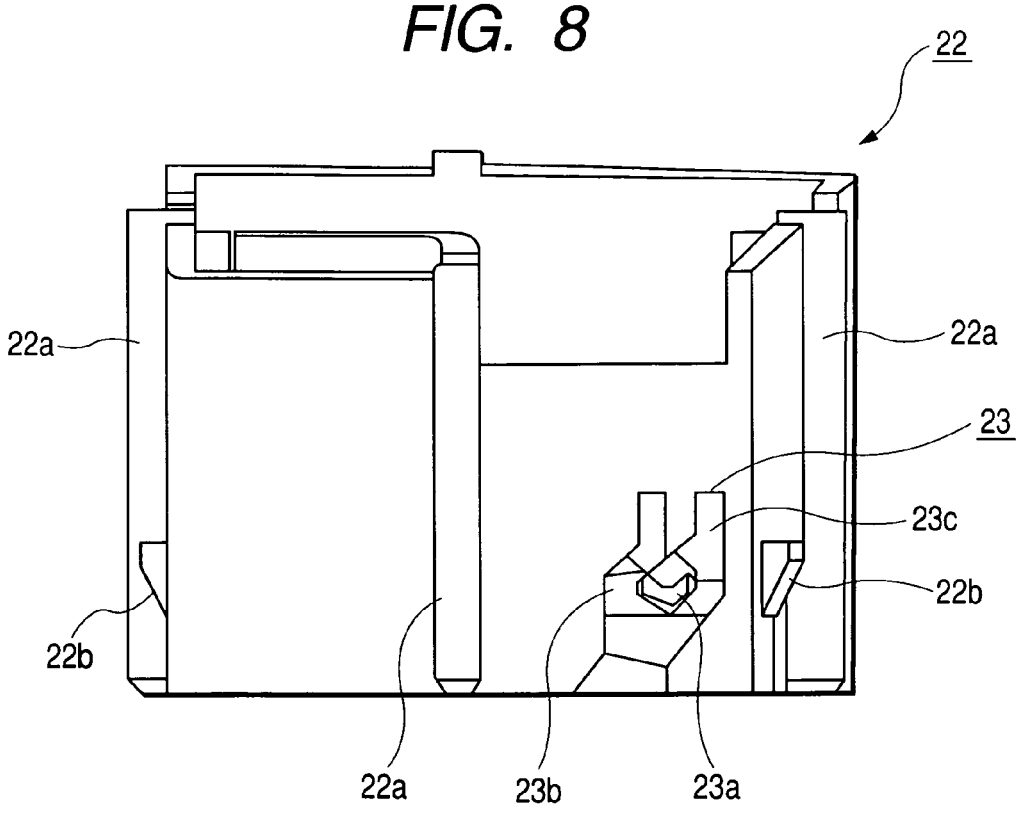
FIG. 8 is a side surface view of a slider provided in the switch unit.
Figure 9:
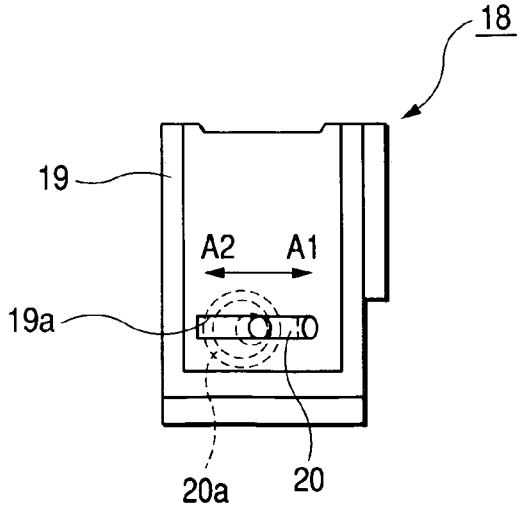
FIG. 9 is a front view of a pin holder provided in the switch unit.
Figure 10:
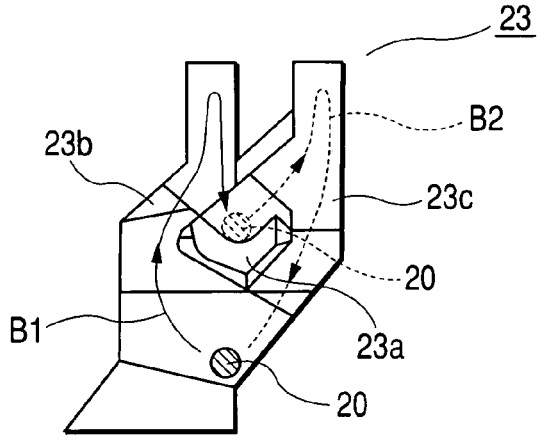
FIG. 10 is an explanatory view of operation of a push locking mechanism provided in the switch unit.

Embodiment of the present invention will now be described with reference to the accompanying drawings. FIG. 1 is a perspective view of a switch unit according to an embodiment of the present invention; FIG. 2 is a perspective view of the switch unit as viewed from a different direction; FIG. 3 is an exploded perspective view of the switch unit; FIG. 4 is a sectional view of the switch unit; FIG. 5 is a plan view of the switch unit; FIG. 6 is an enlarged sectional view of the switch unit taken along the line VI—VI of FIG. 5; FIG. 7 is an enlarged sectional view of the switch unit taken along the line VII—VII of FIG. 5; FIG. 8 is a side view of a slider provided in the switch unit; FIG. 9 is a front view of a pin holder provided in the switch unit; FIG. 10 is an explanatory view illustrating the operation of a push locking mechanism provided in the switch unit; and FIG. 11 is a perspective view of a steering wheel to which the switch unit is attached.

Figure 11:
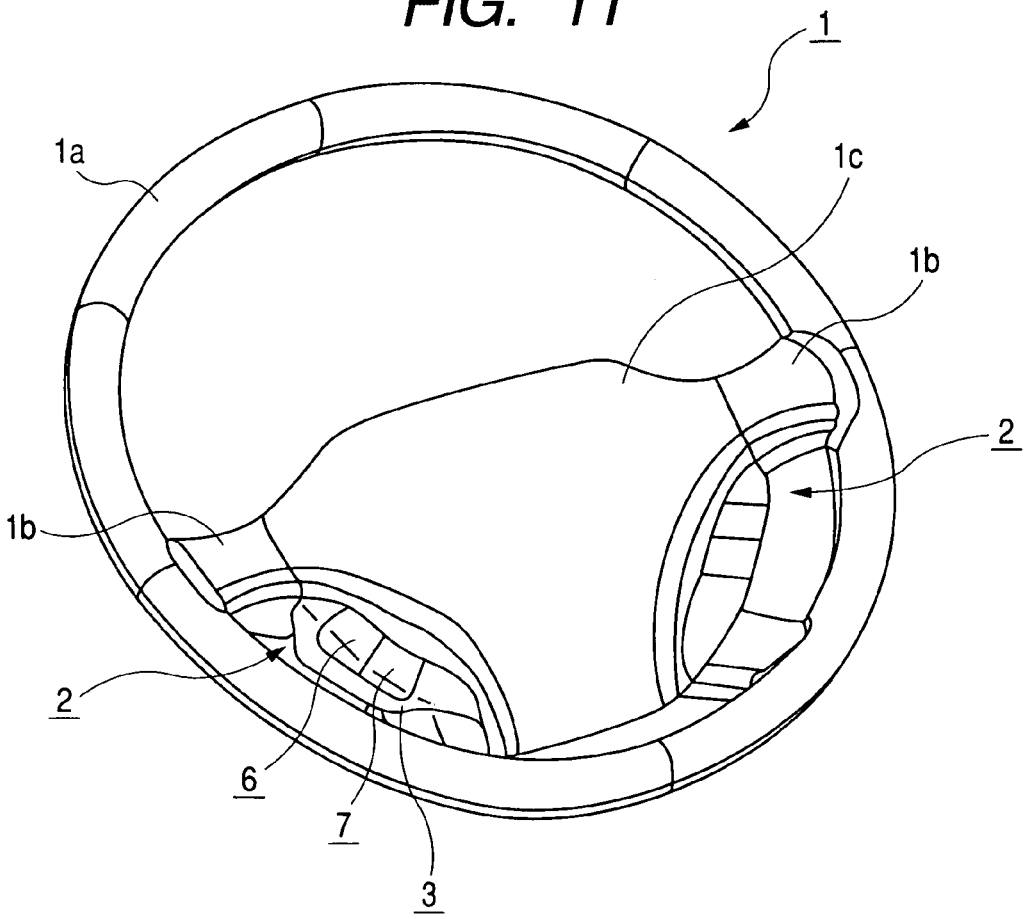
FIG. 11 is a perspective view of a steering wheel to which the switch unit is attached.

As shown in FIG. 11, a steering wheel 1 comprises an annular ring portion 1*a*, a spoke portion 1*b* arranged at the inner side of the ring portion 1*a*, and a pad portion 1*c* for extensively covering the spoke portion 1*b* except a base end portion of the spoke portion 1*b*. Spaces are formed between an inner circumference of the ring portion 1*a* and the pad portion 1*c* at the upper side and the right and left sides of the pad portion. In addition, switch units 2 are arranged at the left and right sides of the pad portion 1*c*, and a part of each of the switch units 2 is exposed to the spaces of both the right side and the left side. In this embodiment, since two switch units 2 which are located at the left and right sides of the pad portion 1*c* are symmetrically provided with respect to the pad portion and have the same basic structure and operation, the switch unit 2 located at the left side of FIG. 11 will be described in the following description.

As shown in FIGS. 1 to 7, the switch unit 2 comprises a case 3 and a cover 4 constituting a switch housing 5, first and second operating knobs 6 and 7 arranged on a top surface of the switch housing 5, and a circuit substrate 8 arranged inside the switch housing 5. The case 3 and the cover 4 are made of synthetic resin, such as ABS resin.

An upper plate portion 3*a* having a pair of openings 9 and 10 formed therein, an external surface portion 3*b* inclined to the inner side from the upper end of an outer circumference of the upper plate portion 3*a* toward the lower side, and a holding plate portion 3*c* protruding from an inner surface of the external surface portion 3*b* toward the inner side are integrally provided in the case 3. The upper plate portion 3*a* and the holding plate portion 3*c* are opposite to each other at a predetermined gap. The holding plate portion 3*c* is set to have a uniform thickness, and a pair of cut-out portions 3*d* is formed at both ends of the holding plate portion 3*c* along a longitudinal direction. One side of the cut-out portion 3*d* opposite to the external surface portion 3*b* is opened, and tapers are formed at opened ends of the cut-out portions 3*d*. A lower plate portion 4*b* having a pair of guide protrusions 4*a* on a back surface side, a standing portion 4*c* protruding from an outer circumferential portion of the lower plate portion 4*b* toward the upper side, and a pair of mounting leg portions 4*d* extending in the longitudinal direction of the lower plate portion 4*b* are integrally provided in the cover 4. The guide protrusions 4*a* are formed in L-shaped leg portions 4*e*. The case 3 and the cover 4 are linked to each other by an assembly process, which will be described later, to be integrated into one body, thereby constituting the switch housing 5. At this time, the lower plate portion 4*b* of the cover 4 is mounted on the holding plate portion 3*c* of the case 3, and the case 3 and the cover 4 are bonded to each other to be integrated into one body, using the lower plate portion 4*b* as a location reference of the height direction. In addition, the guide protrusions 4*a* of the cover 4 are inserted into the cut-out portions 3*d* of the holding plate portion 3*c*, and the case 3 and the cover 4 are bonded to each other to be integrated with one body, using the cut-out portions 3*d* and the guide protrusions 4*a* as a location reference of the horizontal direction. In addition, as shown in FIG. 4, one of the mounting leg portions 4*d* of the cover 4 is located in the spoke portion 1*b* of the steering wheel 1, and the other of the mounting leg portions 4*d* is fixed to another location of the spoke portion 1*b* by a screw, such that the switch housing 5 is fixed to the side surface of the pad portion 1*c*.

A pair of lamps 11 and 12, an LED 13, and a detecting switch 14 are mounted on the circuit substrate 8, and a connector 15 having a plurality of connecting terminals 15*a* is soldered thereto. In addition, a fixed contact 8*a* or a wiring pattern (not shown) is formed thereon. The detecting switch 14 is a small switch of a non-lock type having movable and fixed contacts (not shown) therein, and has a stem 14*a* vertically movable to perform the switching between the contacts. The circuit substrate 8 is fixed on the lower plate portion 4*b* of the cover 4 using a screw (not shown), and the connecting terminals 15*a* of the connector 15 pass through the lower plate portion 4*b* to be exposed to the outside. The circuit substrate 8 is covered with a rubber sheet 16, and the pair of lamps 11 and 12, the LED 13, and the detecting switch 14 pass through the rubber sheet 16. A swelling portion 16*a* is integrally provided on the rubber sheet 16. As shown in FIG. 6, a movable contact 16*b* is provided on an inner bottom surface of the swelling portion 16*a*. The movable contact 16*b* faces the fixed contact 8*a* provided on the circuit substrate 8 at a predetermined gap, and the movable contact 16*b* of the rubber sheet 16 and the fixed contact 8*a* on the circuit substrate 8 constitute a push button switch (switching element).

One opening 9 of the case 3 has a rectangular shape in plan view, and a guide protrusion 9*a* extending in the vertical direction is integrally formed in the inside of the opening 9. A driver 17 is fitted to the guide protrusion 9*a* from the upper side of the opening 9 such that a lower end of the driver 17 comes in contact with the swelling portion 16*a* of the rubber sheet 16. In addition, a pair of shaft portions 3*e* is integrally formed on two inner surfaces of the opening 9 facing each other, and the first operating knob 6 is rotatably supported by the shaft portions 3*e*. Shaft holes 6*b* snap-coupled with the shaft portions 3*e* are formed in the first operating knob 6, and a stopper pawl (not shown) came into contact with the lower end of the opening 9 for restricting a rotation in the upper direction is provided therein. An upper end of the driver 17 comes into contact with a back surface of the first operating knob 6, and a display portion 6*a* for function display is formed at the center of the top surface of the first operating knob 6. The first operating knob 6 is made by applying a light-shielding material on an external surface made of a transmissive colored synthetic resin such that a portion of the external surface is not coated therewith, and the portion in which the light-shielding material is not coated forms the display portion 6*a*. In addition, one lamp 11 on the circuit substrate 8 is arranged right below the first operating knob 6, and light emitted from the lamp 11 is intercepted by the light-shielding material of the first operating knob 6 to pass through only the display portion 6*a*.

The other opening 10 of the case 3 has a concave portion 10*a* recessed from an inner surface thereof. A pin holder 18 is inserted into the concave portion 10*a*. As shown in FIG. 9, the pin holder 18 comprises a holder 19 made of synthetic resin and having a horizontally elongated hole 19*a* on one surface thereof and a sliding pin 20 which is movable in the horizontally elongated hole 19*a* in the direction of an arrow A1–A2 of FIG. 9. A spring portion 20*a* that is wound in a conical shape is provided at a rear end of the sliding pin 20. In addition, the spring portion 20*a* is eccentrically held in the holder 19, so that a biasing force is applied to the sliding pin 20 in the direction of an arrow A1 of FIG. 9. In addition, a stopper plate 21 is locked to the upper end of the concave portion 10*a*, so that it is possible to prevent the pin holder 18 from being detached from the concave portion 10*a* by the stopper plate 21.

The opening 10 has guide grooves 10*b* extending in the vertical direction on each inner surface thereof. Guide protrusions 22*a* formed on the outer surfaces of the slider 22 are fitted to the corresponding guide grooves 10*b*, so that the slider 22, serving as the driver, is supported in the opening 10 so as to be vertically movable. The slider 22 is made of synthetic resin having excellent lubricity, such as polyacetal (POM) or polyamide, and has a hollow structure with the upper and lower ends opened. A plurality of slip-off preventing protrusions 22*b* is formed on the outer surface of the slider 22. The slip-off preventing protrusions 22*b* come into contact with locking means (not shown) formed on the inner surface of the opening 10, so that it is possible to prevent the slip-off preventing protrusions 22*b* from being detached from the opening 10 of the slider 22. In addition, a heart-shaped cam groove 23 is formed on the outer surface of the slider 22 and faces the pin holder 18. As shown in FIG. 8, the heart-shaped cam groove 23 has a locking portion 23*a*, a forward path 23*b*, and a backward path 23*c*, and a connection portion between the forward path 23*b* and the backward path 23*c* forms the locking portion 23*a*. In addition, the sliding pin 20 of the pin holder 18 receives the biasing force of the spring portion 20*a* to engage with the heart-shaped cam groove 23, and the pin holder 18 and the heart-shaped cam groove 23 constitute a push locking mechanism. The operation of the push locking mechanism will be described below.

Further, a partition wall 22*c* is provided at a corner of the inner side of the slider 22, and a light guide 24 made of acrylic resin is press-fitted inside the partition wall 22*c* to be fixed. In addition, a tubular portion 22*d* and a locking protrusion 22*e* are provided inside the slider 22. The tubular portion 22*d* and the locking protrusion 22*e* face each other through the hollow portion of the slider 22. As shown in FIG. 7, a spring supporting portion 3*f* which protrudes toward the inner side of the case 3 is provided on the external surface portion 3*b* of the case 3, and a coil spring 25 serving as a return spring is interposed between the coil supporting portion 3*f* and the tubular portion 22*d*. Therefore, the slider 22 is always biased upward by the resilient force of the coil spring 25. Further, a vertical portion of a plate spring 26 which is bent in an L shape is locked to the locking protrusion 22*e* of the slider 22, and a horizontal portion of the plate spring 26 comes into contact with the stem 14*a* of the detecting switch 14 mounted on the circuit substrate 8.

The above-mentioned second operating knob 7 is integrally snap-coupled with the upper end of the slider 22, and a first display portion 7*a* for function display and a second display portion 7*b* for operation display are formed on the top surface of the second operating knob 7. The second operating knob 7 is, for example, made by applying a light-shielding material on an external surface made of a transmissive colored synthetic resin such that a portion of the external surface is not coated therewith, and the portion in which the light-shielding material is not coated forms the first display portion 7*a*. In addition, a protrusion 24*a* provided on the top surface of the light guide 24 is fitted into a small hole formed on the top surface of the second operating knob 7, so that the upper end surface of the protrusion 24*a* forms the second display portion 7*b*. Further, the other lamp 12 provided on the circuit substrate 8 is arranged right below the second operating knob 7, and light emitted from the lamp 12 is intercepted by the slider 22 and the light-shielding material of the second operating knob 7 to pass through only the first display portion 7*a*. Furthermore, the LED 13 provided on the circuit substrate 8 is arranged right below the partition wall 22*c*, and light emitted from the LED 13 is intercepted by the partition wall 22*c* and thus is guided to the protrusion 24*a* of the light guide 24.

When the switch unit 2 is assembled, first, the circuit substrate 8 on which circuit components, such as the lamps 11 and 12, are mounted is fixed on the lower plate portion 4*b* of the cover 4, and the circuit substrate 8 is covered with the rubber sheet 16. Then, the lamps 11 and 12, the LED 13, and the detecting switch 14 which are provided on the circuit substrate 8 are exposed from the rubber sheet 16 toward the outside. Next, the cover 4 is inserted between the upper plate portion 3*a* and the holding plate portion 3*c* of the case 3 from the side such that the cover 4 collides against the inner surface of the external surface portion 3*b*, and the cover 4 is fixed to the case 3 using a screw (not shown). As a result, the switch housing 5 is formed, and a space formed between the upper plate portion 3*a* and the holding plate portion 3*c* of the case 3 is closed by the standing portion 4*c* of the cover 4. In this case, in the course of inserting the lower plate portion 4*b* of the cover 4 into the case 3 along the holding plate portion 3*c*, the guide protrusions 4*a* are inserted into the cut-out portions 3*d* so that the case 3 and the cover 4 are located in a horizontal direction. Therefore, it is possible to simply and accurately insert the cover 4 into the case 3. In addition, since the case 3 and the cover 4 are linked to each other to be integrated into one body using the lower plate portion 4*b* as the location reference of the height direction, it is possible to accurately locate the light sources (the lamps 11 and 12, and the LED 13) and the detecting switch 14 on the circuit substrate 8.

Next, in a state in which the case 3 and the cover 4 are integrally linked to each other to form the switch housing 5, the driver 17 is fitted to the guide protrusion 9*a* of the case 3 from the upper side of one opening 9. Then, by snapping the shaft hole 6*b* of the first operating knob 6 in the shaft portion 3*e* of the opening 9, the first operating knob 6 is rotatably supported by the inner surface of the opening 9. In addition, the pin holder 18 is inserted into the concave portion 10*a* of the other opening 10 to lock the stopper plate 21, and the slider 22 into which the light guide 24 and the plate spring 26 are incorporated and the second operating knob 7 are integrated into one body by snap-coupling. Then, in a state in which the coil spring 25 is interposed between the spring supporting portion 3*f* and the tubular portion 22*d*, the guide protrusion 22*a* is inserted into the guide groove 10*b*, so that the second operating knob 7 and the slider 22 are supported in the opening 10 so as to be movable in the vertical direction. The order of fitting the first and second operating knobs 6 and 7 to the case 3 does not matter. Therefore, by fitting the first and second operating knobs 6 and 7 to the case 3, the assembly of the switch unit 2 is completed. As described above, when the switch units 2 are arranged at the left and right sides of the pad portion 1*c*, one of the mounting leg portions 4*d* of the cover 4 may be located in the spoke portion 1*b* of the steering wheel 1, and the other of the mounting leg portions 4*d* is screwed to another position of the spoke portion 1*b*. In addition, as shown in FIG. 7, external connectors 27 extending from the pad portion 1*c* are connected to the connecting terminal 15*a* of the connector 15 exposed from the lower plate portion 4*b* of the cover 4, respectively such that the switch unit 2 and the steering wheel 1 are electrically connected to each other.

Next, the operation of the switch unit 2 having the above-mentioned structure will be described. As described above, the switch units 2 are arranged at the left and right sides of the pad portion 1*c* of the steering wheel 1, and the first and second operating knobs 6 and 7 arranged on the upper plate portion 3*a* of the case 3 protrude to the spaces formed between the inner circumference of the ring portion 1*a* and the pad portion 1*c*. In addition, the external surface portion 3*b* of the case 3 is exposed to the side direction of the pad portion 1*c* to be visible externally, but a linking portion between the case 3 and the cover 4 is covered with the external surface portion 3*b* not to be visible externally.

First, the operation of the first operating knob 6 will be described. As shown in FIG. 6, in a non-operation state in which the external force is not applied to the first operating knob 6, since the driver 17 receives the resilient force of the swelling portion 16*a* of the rubber sheet 16 to be located at an ascent position, the first operating knob 6 which comes into contact with the upper end of the driver 17 is stably supported at a non-operating position. At this time, since the movable contact 16*b* which is provided on the inner bottom surface of the swelling portion 16*a* and the fixed contact 8*a* which is provided on the circuit substrate 8 are spaced from each other, the push button switch operated by the first operating knob 6 is in an off state.

In the switch-off state, when a driver that holds the ring portion 1*a* of the steering wheel 1 presses an outer surface of the first operating knob 6 with a thumb, the first operating knob 6 is rotated in the counterclockwise direction of FIG. 6 with the shaft portion 3*e* used as the center, so that the driver 17 descends to press the swelling portion 16*a*. Then, at the time when the swelling portion 16*a* is pressed, the movable contact 16*b* contacts the fixed contact 8*a*, so that the push button switch becomes the on state. In addition, when the pressing force to the first operating knob 6 is released, the driver 17 ascends by the force of restitution of the swelling portion 16*a*. As a result, the first operating knob 6 automatically returns to the non-operating position shown in FIG. 6, so that the push button switch returns to the off state. In addition, when the lamp 11 provided on the circuit substrate 8 is turned on by a switch (not shown), light emitted from the lamp 11 passes through the display portion 6*a* to be emitted to the outside of the first operating knob 6. Therefore, the driver can easily perceive the function of the first operating knob 6 in a dark environment, such as night, by seeing the display portion 6*a* illuminated by the lamp.

Next, the operation of the second operating knob 7 will be described. As shown in FIG. 7, in a non-operating state in which the external force is not applied to the second operating knob 7, since the second operating knob 7 and the slider 22 receive the resilient force of the coil spring 25 to be maintained in an ascent position, and the plate spring 26 is also at the ascent position, so that the detecting switch 14 is in an off state. At this time, the positional relationship between the heart-shaped cam groove 23 formed on the outer surface of the slider 22 and the sliding pin 20 of the pin holder 18 held in the concave portion 10*a* of the case 3 has the relationship as shown in a solid line of FIG. 10. The sliding pin 20 engages with a middle portion of a circular path composed of the forward path 23*b* and the backward path 23*c*.

In the switch-off state, when a driver that holds the ring portion 1*a* of the steering wheel 1 presses the outer surface of the second operating knob 7 with a thumb, the slider 22 receives the resilient force of the coil spring 25 to descend. As a result, the plate spring 26 presses down the stem 14*a* of the detecting switch 14 so that the detecting switch 14 becomes an on state. Here, the detecting switch 14 becomes the on state at a predetermined position before reaching the lowest position of the slider 22. Then, when the slider 22 descends to the lowest position, the plate spring 26 is elastically deformed so that the switch-on state is maintained. In addition, the LED 13 provided on the circuit substrate 8 emits light on the basis of an on signal of the detecting switch 14, and the emitted light is guided to the protrusion 24*a* of the light guide 24 to illuminate the second display portion 7*b*. Therefore, it is possible to confirm the on state of the detecting switch 14 from the outside of the second operating knob 7. In addition, the positional relationship between the heart-shaped cam groove 23 and the sliding pin 20 is changed according to the descending operation of the slider 22, and the second operating knob 7 and the slider 22 are locked at the descent position. Specifically, when the slider 22 descends according to the pressing operation of the second operating knob 7, the sliding pin 20 that engages with the lowest end of the circular path of the heart-shaped cam groove 23 moves to the upper portion of the forward path 23*b*, as represented by arrow B1 in FIG. 10. After the sliding pin 20 reaches the uppermost end of the forward path 23*b*, the pressing force is released. Then, the second operating knob 7 and the slider 22 return a little to the upper side by the elastic force of the coil spring 25. As a result, the sliding pin 20 is locked to the locking portion 23*a* of the heart-shaped cam groove 23 as represented by a broken line in FIG. 10.

Meanwhile, when the outer surface of the second operating knob 7 locked at the descent position is pressed again, the sliding pin 20 is taken off from the locking portion 23*a* of the heart-shaped cam groove 23 to move to the upper portion of the backward path 23*c* as represented by arrow B2 in FIG. 10. Here, when the pressing force is released, the second operating knob 7 and the slider 22 ascend to the upper side by the elastic force of the coil spring 25, so that the sliding pin 20 moves from the backward path 23*c* to the lowest end of the circular path. As a result, the second operating knob 7 and the slider 22 automatically return to the non-operating position shown in FIG. 7, so that the detecting switch 14 becomes the off state. In addition, when the lamp 12 on the circuit substrate 8 is turned on by a switch (not shown), the light emitted from the lamp 12 passes through the first display portion 7*a* from the hollow portion of the slider 22, so that the light is emitted to the outside of the second operating knob 7. Therefore, the driver can easily perceive the function of the second operating knob 7 in a dark environment, such as night, by seeing the first display portion 7*a* illuminated by the lamp.

As described above, in the steering switch device according to the present embodiment, the upper plate portion 3*a* having the pair of openings 9 and 10 formed therein, the external surface portion 3*b* inclined to the inner side from an upper end of the outer circumference of the upper plate portion 3*a* toward the lower side, and the holding plate portion 3*c* protruding from the inner surface of the external surface portion 3*b* toward the inner side are integrally provided in the case 3 made of synthetic resin. In addition, the cover 4 is inserted to the case 3 from the sides of the upper plate portion 3*a* and the holding plate portion 3*c* to be integrated with the case, thereby constituting the switch housing 5. Further, the switch housing 5 is fixed to the side portion of the pad portion 1*c* of the steering wheel 1. Therefore, it is possible to simply attach the cover 4 to the case 3 using the holding plate portion 3*c* as the inserting guide, and it is possible to locate the case 3 and the cover 4 in the height direction. Thus, regardless of fixing the switch housing 5 to the side portion of the pad portion 1*c* to thus improve the operability of the first and second operating knobs 6 and 7, it is possible to prevent a dividing line between the case 3 and the cover 4 from occurring on the external surface of the switch housing 5, and thus it is possible to achieve a steering switch device having good design.

In addition, the pair of guide protrusions 4*a* is integrally formed on the back surface of the lower plate portion 4*b* of the cover 4, and the cut-out portions 3*d* into which the guide protrusions 4*a* are fitted are formed in the holding plate portion 3*c* of the case 3. Therefore, when the lower plate portion 4*b* of the cover 4 is inserted into the case 3 along the holding plate portion 3*c*, the guide protrusions 4*a* are inserted into the cut-out portions 3*d*, so that the case 3 and the cover 4 are located in the horizontal direction. Thus, it is possible to simply fit the cover 4 to the case 3. In addition, the case 3 and the cover 4 are linked to each other to be integrated into one body, thereby constituting the switch housing 5. Then, components, such as the driver 17 and the coil spring 25, can be provided into the case from the upper sides of the openings 9 and 10 that are provided in the upper plate portion 3*a* of the case 3, and the first operating knob 6 and the second operating knob 7 integrated with the slider 22 can be fitted to the case from the upper sides of the openings 9 and 10. Thus, it is possible to improve the workability of assembly.

Further, in the above-mentioned embodiment, the two-arranged type of steering switch in which the two openings 9 and 10 are formed to be adjacent to each other in the upper plate portion 3*a* of the case 3 and the first and second operating knobs 6 and 7 corresponding to the openings 9 and 10 are provided is described. The present invention is not limited to the above-mentioned embodiment, but the present invention can be applied to a structure in which the first operating knob 6 or the second operating knob 7 is used or a structure in which three or more openings or operating knobs are used.

According to the steering switch device of the present invention, by using the holding plate portion of the case protruding from an inner surface of the external surface portion inclined to the inner side from an upper end of the outer circumference of the upper plate portion toward the lower side as an inserting guide, it is possible to simply fit the cover to the case, and it is possible to locate the case and the cover in the height direction to constitute the switch housing. Therefore, regardless of fixing the switch housing to the side portion of the pad portion to thus improve the operability of the operating knobs, it is possible to prevent a dividing line between the case and the cover from occurring in the appearance of the switch housing to thus achieve a steering switch device having good design.

What is claimed is:

1. A steering switch device comprising a steering wheel in which a pad portion is connected to an inner side of an annular ring portion through spoke portions; a switch housing fixed to side portions of the pad portion; operating knobs arranged on a top surface of the switch housing; switch elements operated by the operating knobs; and a circuit substrate on which the switch elements are mounted, the switch housing comprising a case and a cover made of a synthetic resin which are integrally linked to each other, wherein an upper plate portion having the operating knobs arranged thereon, an external surface portion inclined inward from an upper end of an outer circumference of the upper plate portion toward a lower side of the case, and a holding plate portion protruding from an inner surface of the external surface portion toward an inner side to face the upper plate portion are integrally provided in the case, and wherein the cover is inserted between the upper plate portion and the holding plate portion, a lower plate portion for fixing the circuit substrate is provided in the cover, and the lower plate portion is mounted on the holding plate portion.

2. The steering switch device according to claim 1, wherein guide protrusions are integrally provided on a back surface of the lower plate portion, and cut-out portions into which the guide protrusions are inserted are formed in the holding plate portion.

3. The steering switch device according to claim 2, wherein the guide protrusions have a leg portions, and the holding plate portion is sandwiched between the leg portions and the back surface of the lower plate portion when the guide protrusions are inserted into the cut-out portions.

4. The steering switch device according to claim 2, wherein a driver is provided between the operating knobs and the switch elements, an opening into which the driver is inserted is formed in the upper plate portion of the case, and a guide portion that guides an ascending/descending movement of the driver is provided in an inner wall of the opening.

5. The steering switch device according to claim 4, wherein openings are formed in the upper plate portion of the case so as to be adjacent to each other, and a plurality of operating knobs are provided on the upper plate portion so as to correspond to the plurality of openings, respectively.

6. The steering switch device according to claim 1, wherein a driver is provided between the operating knobs and the switch elements, an opening into which the driver is inserted is formed in the upper plate portion of the case, and a guide portion that guides an ascending/descending movement of the driver is provided in an inner wall of the opening.

7. The steering switch device according to claim 6, wherein a plurality of openings are formed in the upper plate portion of the case so as to be adjacent to each other, and operating knobs are provided on the upper plate portion so as to correspond to the plurality of openings, respectively.

* * * * *